United States Patent [19]

Weaver

[11] 4,182,092

[45] Jan. 8, 1980

[54] BUILDING PANEL CHORD TIE AND METHOD OF TIEING TOGETHER PRECAST CONCRETE BUILDING PANELS

[76] Inventor: Floyd E. Weaver, 3839 Birch St., Newport Beach, Calif. 92660

[21] Appl. No.: 880,380

[22] Filed: Feb. 23, 1978

[51] Int. Cl.[2] ..... E04C 3/20

[52] U.S. Cl. ..... 52/583; 52/587; 52/699; 52/707; 52/745

[58] Field of Search ..... 52/227–229, 52/584, 583, 578, 587, 699, 704, 707, 127, 99, 745

[56] References Cited

U.S. PATENT DOCUMENTS

| | | | |
|---|---|---|---|
| 1,726,286 | 8/1929 | Bennet | 52/699 |
| 3,181,276 | 5/1965 | Ballou | 52/701 |
| 3,216,171 | 11/1965 | Jenkins | 52/99 |
| 3,369,334 | 2/1968 | Berg | 52/584 |

FOREIGN PATENT DOCUMENTS

| | | | |
|---|---|---|---|
| 711449 | 6/1954 | United Kingdom | 52/227 |

*Primary Examiner*—James L. Ridgill, Jr.
*Attorney, Agent, or Firm*—Harvey C. Nienow

[57] ABSTRACT

A chord tie for connecting together adjacent precast concrete building panels and method for tieing together such panels in contiguous relation. Such chord tie comprises an elongated anchor member having an offset portion to be embedded in the concrete during casting of the panel, and a bolt-retaining member connected to such anchor member to receive a fastening bolt. The offset portion comprises a reversely bent portion and the bolt-retaining member comprises a pair of metal straps or plates welded to the anchor member in spaced relation to receive the body of a fastening bolt. The chord tie is cast in the concrete panel, the reversely bent portion retaining the chord tie in such position, and the bolt-remaining means is positioned along the edge of the panel. Two adjacent precast panels are connected together by means of the bolt extending between adjacent chord ties and filler washers are employed therebetween.

6 Claims, 8 Drawing Figures

BUILDING PANEL CHORD TIE AND METHOD OF TIEING TOGETHER PRECAST CONCRETE BUILDING PANELS

The present invention relates generally to chord ties for precast concrete building panels and to the method for tieing together precast concrete building panels by use of such chord ties. More particularly, this invention pertains to unique methods and structures for carrying out the procedure whereby adjacent concrete panels are firmly tied to each other in contiguous relation.

In the building of tilt-up structures such as commercial and industrial buildings wherein concrete panels are first precast and members later are titled up into position to serve as wall members of the building, it is heretofore been difficult and expensive to firmly secure together such panels. That is, the usual prior practice has been to have some of the welding reinforcing bars project from the panel, and then when the panels are in position, to weld such bars to a loose angle in a slot near the top of the panel to make a contiguous wall section. It has been found that such parts are usually very dirty, and almost without exception are impossible to align properly. Therefore, it has been extremely difficult to properly weld such members together to make the desired wall section.

Also, in accordance with building code requirements, it has been necessary to employ a certified welder and a field inspector to perform, supervise and inspect the welding procedures. Such personnel are expensive in relation to assemblers or laborers who normally perform the major functions in erecting a building.

Because of these disadvantages, it is an object of the present invention to provide a chord tie which can be located properly in a precast concrete building panel to insure proper assembly of adjacent panels.

Another object of the present invention is to provide a chord tie as characterized above which can be shop-fabricated away from the building site as well as the location where the concrete building panels are cast.

A further object of the present invention is to provide a chord tie as characterized above which enables concrete panels to be properly aligned and firmly secured together with the use of ordinary high tension bolts.

A still further object of the present invention is to provide a chord tie as characterized above which is simple and inexpensive to manufacture and which is rugged and dependable in operation.

An even still further object of the present invention is to teach a method of fastening together adjacent concrete panels of a building without the need for special skills or tools.

Another object of the present invention is to teach such method whereby the spacing between adjacent concrete panels can be filled in to provide a functional and pleasant appearing finished structure.

The novel features which I consider characteristic of my invention are set forth with particularity in the appended claims. The invention itself, however, both as to its organization and mode of operation, together with additional objects and advantages thereof, will best be understood from the following description of the specific embodiments when read in connection with the accompanying drawings, in which:

Like reference characters indicate corresponding parts throughout the several views of the drawing.

Figure 1:
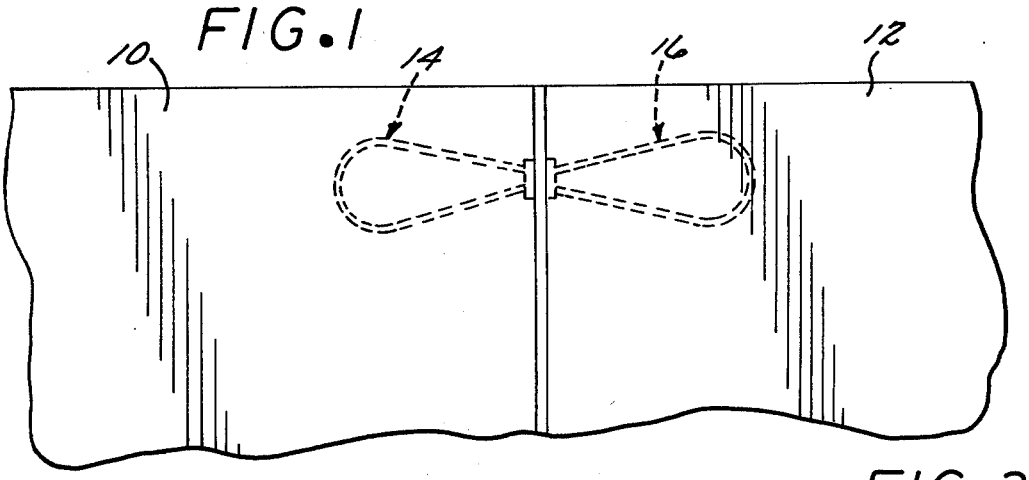
FIG. 1 is a fragmentary side elevational view of a pair of adjacent concrete building panels.

Referring to FIG. 1 of the drawings, there is shown therein precast concrete building panels 10 and 1 which are tied together by chord ties 14 and 16 in accordance with the present invention. Such concrete panels may be of substantially any size or shape in accordance with the design and construction of the building being assembled, and frequently are from 20 to 30 feet high and 8 to 12 feet wide.

As shown most particularly in FIG. 2 of the drawings, the chord tie 16 comprises an elongated anchor member 18 one end of which is offset or reversely bent as at **18*a*** to enable the chord tie to be firmly embedded in the concrete panel as will hereinafter be explained in greater detail. Such anchor member may be formed of any appropriate high strength material, such as steel.

Figure 5:
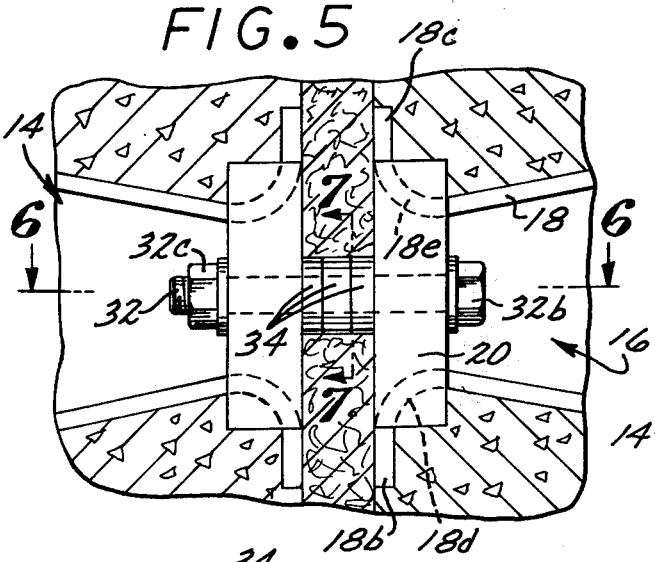
FIG. 5 is a fragmentary view of a portion of several panels tied together.

As most clearly shown in FIG. 5 of the drawings, the anchor member 18 is generally bifurcated having a pair of bifurcated end portions **18*b* and 18*c* which are aligned in a substantially coplanar manner by virtue of arcuate portions 18*d* and 18*e*. As will hereinafter appear in great detail, such coplanar arrangement of the end portions 18*b* and 18*c* is desirable to enable the chord tie 16** to be fastened to the casting form or frame for the panel.

Firmly secured to the bifurcated ends **18*b* and 18*c* of anchor member 18 is a pair of metal straps 20 and 22. As shown most clearly in FIG. 6 of the drawings, strap 20 is welded to one side of the end portions 18*b* and 18*c* and strap 22** is welded to the other side thereof, providing a space therebetween and bolt-retaining means as will hereinafter be explained in greater detail.

Figure 2:
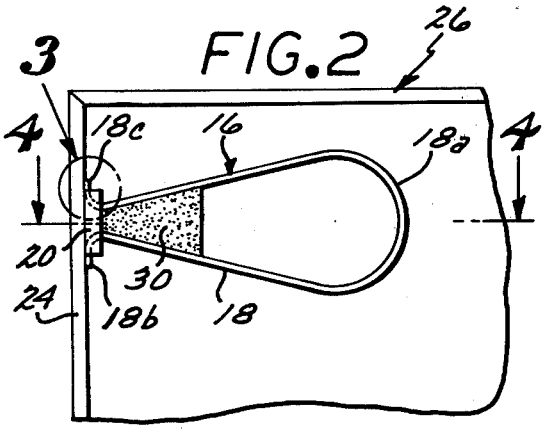
FIG. 2 is a fragmentary plan view of a form for casting concrete building panels, showing the chord tie in place.
Figure 3:
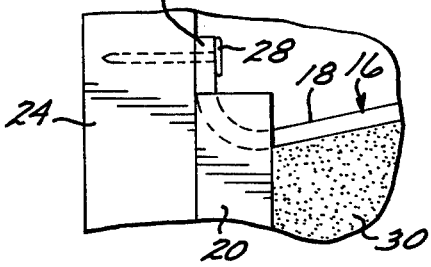
FIG. 3 is a fragmentary enlarged view of area 3 of FIG. 2.

As shown most clearly in FIGS. 2 and 3 of the drawings, the chord tie 16 is secured to one side 24 of a form 26 which is used for casting the concrete panel 12. That is, in the making of concrete building panels, a form is used consisting of a frame having four wood sides. It is within this form that the concrete is poured and allowed to set so that a complete panel is thereby provided.

The bifurcated end portions **18*b* and 18*c* are formed with through holes for individually receiving a fastening nail 28 which is driven into the form member 24** to thereby properly hold the chord tie in place during forming of the concrete panel.

For purposes which will hereinafter become more apparent, a styrofoam block-out 30 is formed between the bifurcated portions of the elongated anchor member 18. Such block-out extends between the plates 20 and 22.

Figure 4:
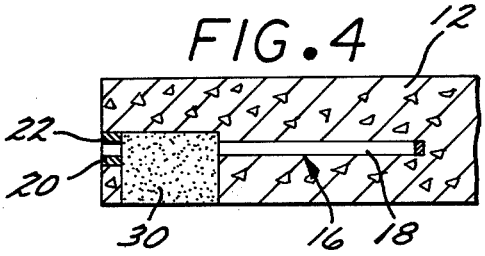
FIG. 4 is a fragmentary sectional view taken substantially along line 4—4 of FIG. 2.

With the chord tie thus properly positioned in the form 26 and with the block-out 30 in its desired location, the form 26 is filled with concrete. After the concrete has properly set, the frame or form 26 is removed thereby exposing the end portions 18*b* and 18*c* along the edge of the panel. FIG. 4 shows the location of the chord tie and the block-out after the concrete has been poured into the form 26.

The block-out 30 is then removed, either by dissolving the same with gasoline or by chipping and removing it so that the space between the bifurcated arms of the anchor member as well as the space between the plates 20 and 22 are exposed.

Figure 6:
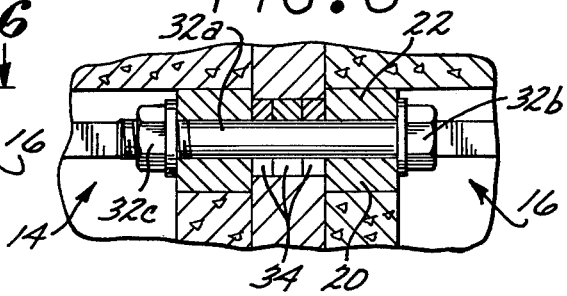
FIG. 6 is a fragmentary sectional view taken substantially along line 6—6 of FIG. 5.
Figure 7:
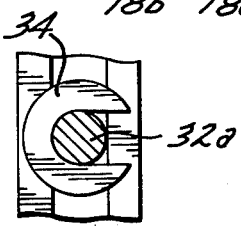
FIG. 7 is a fragmentary sectional view taken substantially along line 7—7 of FIG. 5.

With the various building panels thus constructed, they are tilted up into position and a high tension bolt 32 is inserted in the space between the plates of adjacent chord ties as shown in FIGS. 5 and 6. The space between the straps or plates 20 and 22 if each chord tie is such as to receive the shank 32*a* if bolt 32 but is too small to allow the head 32*b* or nut 32*c* to pass therethrough.

In order to properly space the panels 10 and 12 and to permit the shank 32*a* of bolt 32 to be able to take both tension and compression, it has been found desirable to position C-shaped filler washers 34 on shank 32*a* between the chord ties 14 and 16. Thus, the space between adjacent panels 10 and 12 which may be on the order of ¼ inch to 1 inch, is taken up with filler washers 34 at the bolt 32. By tightening the nut 32*c* on the bolt 32, the panels are firmly secured to each other and the bolt 32 is able to withstand any reasonable shock which might cause either tension or compression on bolt 32.

The space between the thus assembled concrete panels 10 and 12 is filled with caulking such as oakum and mastic or it may be filled with dry mortar or a strip of foam. At the same time, the open space between the arms of the bifurcated anchor member can be filled with such material to provide a finished appearance to the entire connection between the panels.

Figure 8:
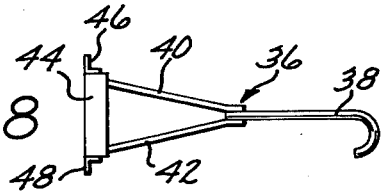
FIG. 8 is an elevational view of a second embodiment of the present invention.

The second embodiment shown in FIG. 8 of the drawings comprises an elongated anchor member having a reversely bent member 38 which is welded to and between a pair of arms 40 amd 42. Two straps or plates, one of which is shown at 44, are welded to opposite sides of the ends of the arms 40 and 42, and L-shaped mounting members 46 and 48 are provided to enable the chord tie 36 to be properly anchored to the frame member of a concrete form, as above explained with respect to the first embodiment.

It is thus seen that the present invention provides a chord tie which can be firmly anchored within a concrete building panel and which can be utilized to permit a building method to be followed in firmly securing together such building panels.

Although I've shown described certain specific embodiments of my invention, I am well aware than many modifications thereof are possible. The invention itself is not to be restricted except insofar as is necessitated by the prior art and by the spirit of the appended claims. I claim:

1. A chord tie for concrete building panels comprising in combination, an elongated anchor member formed at one end with a reversely-bent portion and at the other end being bifurcated to provide a pair of spaced coplanar portions having means for anchoring said member to a form, and bolt-retaining means attached to said other end of said anchor member comprising a pair of straps individually welded to opposite sides of said coplanar portions to receive and retain a fastening bolt.

2. A chord tie for concrete building panels according to claim 1 wherein said straps are welded to and between said bifurcated portions to form a space therebetween for receiving the shank of the fastening bolt while preventing the passage therebetween of the head of such bolt, each of said straps having an edge which is substantially coplanar with the coplanar portions of said anchor member.

3. A chord tie for concrete building panels according to claim 2 wherein said anchor member is a strap of steel formed with a centrally located reverse bend and having opposite ends providing said coplanar portions, and said pair of straps are welded thereto.

4. The method of tieing together concrete building panels in contiguous relation comprising the steps of providing a chord tie by forming an elongated anchor member at one end with a reversely bent portion and at the other end with a pair of space co-planar portions, then welding a pair of spaced straps one on either side said reversely bent portions;

embedding in each of said panels a chord tie inserting a fastening bolt in the bolt-retaining means of adjacent concrete panels, and tightening the nut of said bolt to draw said panels into firm contiguous relation.

5. The method of tieing together concrete building panels in contiguous relation according to claim 4 wherein each chord tie is located in a predetermined position in the form for making the respective panel, a styrofoam block-out is positioned at said bolt-retaining means of each chord tie before concrete is poured into said form and allowed to set to make said panel having said chord tie therein and said block-out is removed after the concrete is set and a bolt is inserted in said bolt-retaining means.

6. The method of tieing together concrete building panels in contiguous relation according to claim 5 wherein filler washers are positioned on the shank of said fastening bolt between the bolt-retaining means of adjacent chord ties before the nut of said bolt is tightened.

* * * * *